United States Patent [19]

Yu

[11] Patent Number: 4,983,481

[45] Date of Patent: Jan. 8, 1991

[54] ELECTROSTATOGRAPHIC IMAGING SYSTEM

[75] Inventor: Robert C. U. Yu, Webster, N.Y.

[73] Assignee: Xerox Corporation, Stamford, Conn.

[21] Appl. No.: 293,165

[22] Filed: Jan. 3, 1989

[51] Int. Cl.[5] ..... G03G 5/047; G03G 5/10

[52] U.S. Cl. ..... 430/59; 430/56; 430/58; 430/126; 430/930

[58] Field of Search ..... 430/56, 58, 59, 69, 430/126, 930

[56] References Cited

U.S. PATENT DOCUMENTS

| | | | |
|---|---|---|---|
| 3,493,427 | 2/1970 | Takagi et al. | 430/56 X |
| 3,861,942 | 1/1975 | Suestaux . | |
| 4,202,937 | 5/1980 | Fukuda et al. | 430/58 |
| 4,265,990 | 5/1981 | Stolka et al. | 430/59 |
| 4,381,337 | 4/1983 | Chang | 430/58 |
| 4,390,609 | 6/1983 | Wiedemann | 430/58 |
| 4,391,888 | 7/1983 | Chang et al. | 430/57 |
| 4,747,992 | 5/1988 | Sypula et al. | 249/183 X |
| 4,772,526 | 9/1988 | Kan et al. | 430/58 |

FOREIGN PATENT DOCUMENTS

| | | | |
|---|---|---|---|
| 58-107548 | 6/1983 | Japan | 430/56 |
| 62-28767 | 2/1987 | Japan | 430/930 |
| 62-280752 | 12/1987 | Japan | 430/930 |

*Primary Examiner*—Roland E. Martin

[57] ABSTRACT

An imaging member having a flexible supporting substrate layer, an electrically conductive layer, an optional adhesive layer, a charge generator layer and a change transport layer, the supporting layer having a thermal contraction coefficient substantially identical to the thermal contraction coefficient the charge transport layer. This imaging member may be employed in an electrostatographic imaging process.

18 Claims, No Drawings

ELECTROSTATOGRAPHIC IMAGING SYSTEM

BACKGROUND OF THE INVENTION

This invention relates in general to electrostatography and, more specifically, to a flexible, curl resistant electrophotoconductive imaging member.

In the art of xerography, a xerographic plate comprising a photoconductive insulating layer is imaged by first uniformly depositing an electrostatic charge on the imaging surface of the xerographic plate and then exposing the plate to a pattern of activating electromagnetic radiation such as light which selectively dissipates the charge in the illuminated areas of the plate while leaving behind an electrostatic latent image in the non-illuminated areas. This electrostatic latent image may then be developed to form a visible image by depositing finely divided electroscopic marking particles on the imaging surface.

A photoconductive layer for use in xerography may be a homogeneous layer of a single material such as vitreous selenium or it may be a composite layer containing a photoconductor and another material. One type of composite photoconductive layer used in electrophotography is illustrated in U.S. Pat. No. 4,265,990. A photosensitive member is described in this patent having at least two electrically operative layers. One layer comprises a photoconductive layer which is capable of photogenerating holes and injecting the photogenerated holes into a contiguous charge transport layer. Generally, where the two electrically operative layers are positioned on an electrically conductive layer with the photoconductive layer sandwiched between a contiguous charge transport layer and the conductive layer, the outer surface of the charge transport layer is normally charged with a uniform electrostatic charge and the conductive layer is utilized as an electrode. In flexible electrophotographic imaging members, the electrode is normally a thin conductive coating supported on a thermoplastic resin web. Obviously, the conductive layer may also function as an electrode when the charge transport layer is sandwiched between the conductive layer and a photoconductive layer which is capable of photogenerating electrons and injecting the photogenerated electrons into the charge transport layer. The charge transport layer in this embodiment, of course, must be capable of supporting the injection of photogenerated electrons from the photoconductive layer and transporting the electrons through the charge transport layer.

Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain aromatic amine compounds. Various generating layers comprising photoconductive layers exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generation layer may comprise a homogeneous photoconductive material or particulate photoconductive material dispersed in a binder. Other examples of homogeneous and binder charge generation layer are disclosed in U.S. Pat. No. 4,265,990. Additional examples of binder materials such as poly(hydroxyether) resins are taught in U.S. Pat. No. 4,439,507. The disclosures of the aforesaid U.S. Pat. No. 4,265,990 and U.S. Pat. No. 4,439,507 are incorporated herein in their entirety. Photosensitive members having at least two electrically operative layers as disclosed above in, for example, U.S. Pat. No. 4,265,990 provide excellent images when charged with a uniform negative electrostatic charge, exposed to a light image and thereafter developed with finely developed electroscopic marking particles.

When one or more photoconductive layers are applied to a flexible supporting substrate, it has been found that the resulting photoconductive member tends to curl. Curling is undesirable because different segments of the imaging surface of the photoconductive member are located at different distances from charging devices, developer applicators and the like during the electrophotographic imaging process thereby adversely affecting the quality of the ultimate developed images. For example, non-uniform charging distances can be manifested as variations in high background deposits during development of electrostatic latent images. A curled imaging member requires considerable tension to flatten the member against a supporting member. Where the supporting member comprises a large flat area for full frame flash exposure, the member may tear before sufficient flatness can be achieved. Moreover, constant flexing of multilayered photoreceptor belts during cycling can cause stress cracks to form due to fatigue. These cracks print out on the final electrophotographic copy. Premature failure due to fatigue prohibits use of these belts in designs utilizing small roller sizes (e.g. 19 mm or smaller) for effective auto paper stripping. Coatings may be applied to the side of the supporting substrate opposite the photoconductive layer to counteract the tendency to curl. However, such coating requires an additional coating step on a side of the substrate opposite from the side where all the other coatings are applied. This additional coating operation normally requires that a substrate roll be unrolled an additional time merely to apply the anti-curl layer. Also, difficulties have been encountered with these anti-curl coatings. For example, photoreceptor curl can sometimes still be encountered in as few as 1,500 imaging cycles under the stressful conditions of high temperature and high humidity. Further, the anti-curl coatings occasionally separate from the substrate during extended cycling and render the photoconductive imaging member unacceptable for forming quality images. Anti-curl layers will also occasionally delaminate due to poor adhesion to the supporting substrate. Moreover, in electrostatographic imaging systems where transparency of the substrate and anti-curl layer are necessary for rear exposure to activating electromagnetic radiation, any reduction of transparency due to the presence of an anti-curl layer will cause a reduction in performance of the photoconductive imaging member. Although the reduction in transparency may in some cases be compensated by increasing the intensity of the electromagnetic radiation, such increase is generally undesirable due to the amount of heat generated as well as the greater costs necessary to achieve higher intensity.

INFORMATION DISCLOSURE STATEMENT

Guestaux, U.S. Pat. No. 3,861,942 issued Jan. 21, 1975—A concave curvature is imparted to the backing surface of a polyester photographic film support (prior to coating the other surface) by treating the back surface with a volatile phenolic compound and a surfactant in a volatile solvent and drying and heating the film above the second order transition temperature of the polyester to volatize them materials from the surface. A flat photographic film product having no anti-curl backing layer is produced from the concavely curved film upon coating the other surface of the film with one or more layers of the usual coatings used in the structure on the photosensitive side of the film, at least one of the layers being such that it shrinks when drying and imparts a compensating countercurvature force to the film, thereby flattening the film.

Stolka U.S. Pat. No. 4,265,990 et al, issued May 5, 1981—A photosensitive member is disclosed comprising a support layer, a charge generating layer and a charge transport layer. The transport layer may comprise a diamine and a polycarbonate resin. Aluminized Mylar is mentioned as a preferred substrate Chang U.S. Pat. No. 4,381,337 et al, issued July 5, 1983—A photoconductive element is disclosed comprising an electroconductive support, an adhesive layer, a charge generating layer and a charge transport layer. A mixture of a polyester having a glass transition temperature larger than about 60° C. with a polyester having a glass transition temperature smaller than about 30° C. is employed in the adhesive layer and in the charge transport layer. The support, for example, may be an aluminized polyethylene terephthalate film. The charge transport layer also contains suitable charge transport chemicals and an organic binder.

Chang U.S. Pat. No. 4,391,888 et al, issued July 5, 1983—A multilayered organic photoconductive element is disclosed having a polycarbonate barrier layer and a charge generating layer. A polycarbonate adhesive bonding layer is included on the an electroconductive support to provide a receptive and retentive base layer for the charge generating layer.

Wiedemann, U.S. Pat. No. 4,390,609 issued June 28, 1983—An electrophotographic recording material is disclosed comprising an electrically conductive support, an optional insulating intermediate layer, at least one photoconductive layer comprising a charge generating compound and a charge transporting compound and a protective transparent layer. Various binders are listed, for example in column 5, lines 8–19. The protective transparent cover layer comprises a surface abrasion resistant binder composed of a polyurethane resin, a polycarbonate resin, a polyurethane, or a polyisocyanate as well as numerous other binders.

Kan U.S. Pat. No. 4,772,526 et al, issued Sept. 20, 1988—An electrophotographic element is disclosed having a photoconductive surface layer including a binder resin comprising a block copolyester or copolycarbonate having a fluorinated polyether block. The polyester or polycarbonate segments form a continuous phase which gives physical strength to the imaging member while the polyether blocks form a discontinuous phase and provide optimal surface properties.

Fukuda U.S. Pat. No. 4,202,937 et al, issued May 13, 1980—An electrophotographic photosensitive member is disclosed comprising a support layer, a charge injection layer, a subsidiary charge injection layer, a photoconductive layer and an insulating layer. An insulating layer may be also interposed between the support layer and the charge injection layer. The support appears to be made of metal..

Thus, the characteristics of electrostatographic imaging members comprising a supporting substrate coated on one side with at least one photoconductive layer and coated on the other side with an anti-curl layer exhibit deficiencies which are undesirable in automatic, cyclic electrostatographic copiers, duplicators, and printers.

SUMMARY OF THE INVENTION

It is an object of the invention to provide an electrophotographic imaging member which overcomes the above-noted disadvantages.

It is an another object of this invention to provide a thin, flexible electrophotographic imaging member with improved resistance to curling.

It is another object of this invention to provide a thin, flexible electrophotographic imaging member without an anti-curl layer.

It is still another object of this invention to provide a thin, flexible electrophotographic imaging member which exhibits improved resistance to cracking of the charge transport layer.

It is another object of this invention to provide a thin, flexible electrophotographic imaging member having improved adhesion between layers.

It is still another object of this invention to provide a thin, flexible electrophotographic imaging member with improved adhesion between a supporting substrate and the layers which it supports.

The foregoing objects and others are accomplished in accordance with this invention by providing an imaging member comprising a flexible supporting substrate layer, an electrically conductive layer, an optional adhesive layer, a charge generator layer and a charge transport layer, the supporting layer having a thermal contraction coefficient substantially identical to the thermal contraction coefficient the charge transport layer. Generally, the supporting layer and the charge transport layer may have a difference in thermal contraction coefficient of of between about $-2\times10^{-5}/°$ C. and about $+2\times10^{-5}/°$ C. Since this imaging member does not curl, it does not require an anti-curl layer commonly employed on one side of a support layer of electrostatographic imaging members bearing an optional adhesive layer, a charge generator layer and a charge transport layer on the other side.

The flexible supporting substrate layer having an electrically conductive surface may comprise any suitable flexible web or sheet having a thermal contraction coefficient substantially identical to the thermal contraction coefficient of the charge transport layer. The flexible supporting substrate layer having an electrically conductive surface may be opaque or substantially transparent and may comprise numerous suitable materials having the required mechanical properties. For example, it may comprise an underlying flexible insulating support layer coated with a flexible electrically conductive layer, or merely a flexible conductive layer having sufficient internal strength to support the electrophotoconductive layer and anti-curl layer. The flexible electrically conductive layer, which may comprise the entire supporting substrate or merely be present as a coating on an underlying flexible web member, may comprise any suitable electrically conductive material including, for example, aluminum, titanium, nickel, chromium, brass, gold, stainless steel, carbon black, graphite and the like. The flexible conductive layer may vary in thickness over substantially wide ranges depending on the desired use of the electrophotoconductive member. Accordingly, the conductive layer can generally range in thicknesses of from about 50 Angstrom units to many centimeters. When a highly flexible photoresponsive imaging device is desired, the thickness of the conductive layer may be between about 100 Angstrom units to about 750 Angstrom units. Any suitable underlying flexible support layer of any suitable material having a linear thermal contraction coefficient substantially identical to the thermal contraction coefficient of the charge transport layer including a thermoplastic film forming polymer alone or a thermoplastic film forming polymer in combination with other materials such as conductive particles of metal, carbon black and the like. Typical underlying flexible support layers comprising film forming polymers include insulating non-conducting materials comprising various resins such as polyethersulfone resins (PES), polycarbonate resins (Makrofol), polyvinyl fluoride resins (PVF), polystyrene resins and the like. Preferred substrates are polyethersulfone (Stabar S-100, available from from ICI), polyvinyl flouride (Tedlar, available from E. I. DuPont de Nemours & Company), polybisphenol-A polycarbonate (Makrofol, available from Mobay Chemical Company) and amorphous polyethylene terephthalate (Melinar, available from from ICI Americas, Inc.).

The coated or uncoated flexible supporting substrate layer is highly flexible and may have any number of different configurations such as, for example, a sheet, a scroll, an endless flexible belt, and the like. Preferably, the insulating web is in the form of an endless flexible belt and comprises a commercially available polyethersulfone resin known as Stabar S-100, available from from ICI. This substrate material is preferred because it has a thermal contraction (or expansion) coefficient that is closely matched with that of the preferred charge transport materials. Preferred charge transport materials include, for example, polycarbonate, polystyrene, polyarylate and the like. Satisfactory results may be achieved when the difference in linear thermal contraction coefficient between the substrate layer and the charge transport layer is between about $-2\times10^{-5}$/° C. and about $+2\times10^{-5}$/° C. Preferably, the difference in thermal contraction coefficient between the substrate layer and the charge transport layer is between about $-1\times10^{-5}$/° C. and about $-1\times10^{-5}$/° C. Optimum results are achieved when the difference in thermal contraction coefficient between the substrate layer and the charge transport layer is between about $-0.5\times10^{-5}$/° C. and about $+0.5\times10^{-5}$/° C. The linear thermal contraction coefficient is defined as the fractional dimensional shrinking upon cooling per °C. The thermal contraction coefficient characteristics are determined for the substrate and charge transport layers by measurements taken in two directions along the plane of the layers, the two directions being about 90° C. apart. The thermal contraction coefficient (or expansion) may be determined by well known ASTM techniques, including those described, for example, in "Standard Test Method for Coefficient of Cubicle Thermal Expansion of Plastics, ASTM Designation: D 864-52" (Reapproved 1978); "Standard Test Method for Linear Thermal Expansion of Solid Materials with a Vitreous Silica Dilatometer", ASTM Designation: E 228-85; and "Standard Test of Coefficient of Linear Thermal Expansion of Plastics", ASTM Designation: D 696-79. The thermal contraction coefficient for plastics involves a reversible thermal change in length per unit length resulting from a temperature change. The measurements are taken at temperatures below the glass transition temperatures of the film forming polymers in the layers and may be made with any suitable device such as a conventional dilatometer. The thermal contraction coefficient varies significantly when the glass transition temperature is exceeded. Therefore, the thermal contraction coefficient value for purposes of this invention is measured at a temperature below the glass transition temperature. A typical procedure for measuring the thermal contraction coefficient is ASTM D696-79 Standard Test Method For Coefficient of Linear Thermal Expansion of Plastics. As is well known in the art, the thermal contraction coefficient of a material is the same as the thermal expansion coefficient of that material. For purposes of testing to determine the thermal contraction coefficient of a given type of material, each layer is formed and tested as an independent layer. Preferrably, the polymeric substrate has a linear thermal contraction coefficient range between about $5.6\times10^{-5}$/° C. and about $7.5\times10^{-5}$/° C. This range is preferred because it closely matches the linear thermal contraction coefficient range of the preferred charge transport layers.

The film forming polymers employed in the substrate layer and in the charge transport layer should preferrably be isotropic and not anisotropic. An isotropic material is defined as a material having physical and mechanical properties that are identical in all directions. Isotropic materials do not distort when heated or cooled whereas anisotropic materials distort when heated or cooled. Isotropic materials may be tested by either cubical or linear thermal expansion coefficient tests. An anisotropic material is defined as a material having physical and mechanical properties that are not identical in all directions. An example of an anisotropic material is biaxially oriented polyethylene terephthalate (e.g. Mylar, available from E. I. du Pont de Nemours & Co.).

Properties of various preferred substrate materials are set forth in the following Table:

TABLE 1

Physical/Mechanical Properties of Various Preferred Substrates

| Property | PES | PVF | Makrofol | Amorphous PET |
|---|---|---|---|---|
| Thermal Expansion Coeff. (in/in-°C.) | $6.0\times10^{-5}$ | $7.0\times10^{-5}$ | $6.5\times10^{-5}$ | $6.5\times10^{-5}$ |
| Modulus (lb/in$^2$) | $3.5\times10^5$ | $3.1\times10^5$ | $3.2\times10^5$ | $3.0\times10^5$ |
| Tg (°C.) | 225 | 43 | 154 | 69 |
| Creep (at 105° C./85% RH) | Negligible | Substantial | Slight | Moderate |
| Optical Clarity | Clear | Translucent | Clear | Clear |
| $CH_2Cl_2$ Resistant | Sensitive | Swell | Dissolve | Swell |

If desired, any suitable charge blocking layer may be interposed between the conductive layer and the electrophotographic imaging layer. Some materials can form a layer which functions as both an adhesive layer and charge blocking layer. Typical blocking layers include polyvinylbutyral, organosilanes, epoxy resins, polyesters, polyamides, polyurethanes, silicones and the like. The polyvinylbutyral, epoxy resins, polyesters, polyamides, and polyurethanes can also serve as an adhesive layer. Adhesive and charge blocking layers preferably have a dry thickness between about 20 Angstroms and about 2,000 Angstroms.

The silane reaction product described in U.S. Pat. No. 4,464,450 is particularly preferred as a blocking layer material because cyclic stability is extended. The entire disclosure of U.S. Pat. No. 4,464,450 is incorporated herein by reference. These silanes have the following structural formula:

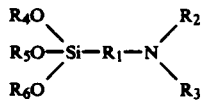

wherein $R_1$ is an alkylidene group containing 1 to 20 carbon atoms, $R_2$ and $R_3$ are independently selected from the group consisting of H, a lower alkyl group containing 1 to 3 carbon atoms, a phenyl group and a ! poly(ethyleneamino) group, and $R_4$, $R_5$, and $R_6$ are independently selected from a lower alkyl group containing 1 to 4 carbon atoms. Typical hydrolyzable silanes include 3-aminopropyltriethoxysilane, N-aminoethyl-3-aminopropyltrimethoxysilane, N-2-aminoethyl-3-aminopropyltrimethoxysilane, N-2-aminoethyl-3-aminopropyltris(ethylethoxy) silane, p-aminophenyl trimethoxysilane, 3-aminopropyldiethylmethylsilane, (N,N'-dimethyl-3-amino)propyltriethoxysilane, 3-aminopropylmethyldiethoxysilane, 3-aminopropyl trimethoxysilane, N-methylaminopropyltriethoxysilane, methyl [2-(3-trimethoxysilylpropylamino)ethylamino]-3-proprionate, (N,N'-dimethyl-3-amino)propyltriethoxysilane, N,N'-dimethylaminophenyltriethoxy silane, trimethoxysilylpropyldiethylenetriamine and mixtures thereof. The blocking layer forming hydrolyzed silane solution may be prepared by adding sufficient water to hydrolyze the alkoxy groups attached to the silicon atom to form a solution. Insufficient water will normally cause the hydrolyzed silane to form an undesirable gel. Generally, dilute solutions are preferred for achieving thin coatings. Satisfactory reaction product layers may be achieved with solutions containing from about 0.1 percent by weight to about 1 percent by weight of the silane based on the total weight of solution. A solution containing from about 0.01 percent by weight to about 2.5 percent by weight silane based on the total weight of solution are preferred for stable solutions which form uniform reaction product layers. The pH of the solution of hydrolyzed silane is carefully controlled to obtain optimum electrical stability. A solution pH between about 4 and about 10 is preferred. Optimum blocking layers are achieved with hydrolyzed silane solutions having a pH between about 7 and about 8, because inhibition of cycling-up and cycling-down characteristics of the resulting treated photoreceptor maximized. Control of the pH of the hydrolyzed silane solution may be effected with any suitable organic or inorganic acid or acidic salt. Typical organic and inorganic acids and acidic salts include acetic acid, citric acid, formic acid, hydrogen iodide, phosphoric acid, ammonium chloride, hydrofluorosilicic acid, Bromocresol Green, Bromophenol Blue, p-toluene sulphonic acid and the like.

Any suitable technique may be utilized to apply the hydrolyzed silane solution to the metal oxide layer of a metallic conductive anode layer. Typical application techniques include spraying, dip coating, roll coating, wire wound rod coating, and the like. Although it is preferred that the aqueous solution of hydrolyzed silane be prepared prior to application to the metal oxide layer, one may apply the silane directly to the metal oxide layer and hydrolyze the silane in situ by treating the deposited silane coating with water vapor to form a hydrolyzed silane solution on the surface of the metal oxide layer in the pH range described above. The water vapor may be in the form of steam or humid air. Generally, satisfactory results may be achieved when the reaction product of the hydrolyzed silane and metal oxide layer forms a layer having a thickness between about 20 Angstroms and about 2,000 Angstroms. As the reaction product layer becomes thinner, cycling instability begins to increase. As the thickness of the reaction product layer increases, the reaction product layer becomes more non-conducting and residual charge tends to increase because of trapping of electrons and thicker reaction product films tend to become brittle prior to the point where increases in residual charges become unacceptable. A brittle coating is, of course, not suitable for flexible photoreceptors, particularly in high speed, high volume copiers, duplicators and printers.

In some cases, intermediate layers between the blocking layer and the adjacent charge generating or photogenerating material may be desired to improve adhesion or to act as an electrical barrier layer. If such layers are utilized, they preferably have a dry thickness between abut 0.01 micrometer to about 5 micrometers. Typical adhesive layers include film-forming polymers such as polyester, polyvinylbutyral, polyvinylpyrolidone, polyurethane, polymethyl methacrylate and the like.

Generally, the electrophotoconductive imaging member of this invention comprises a supporting substrate layer, an optional adhesive layer, a charge generator layer and a charge transport layer. Any suitable charge generating or photogenerating material may be employed as one of the two electrically operative layers in the multilayer photoconductor of this invention. Typical charge generating materials include metal free phthalocyanine described in U.S. Pat. No. 3,357,989, metal phthalocyanines such as copper phthalocyanine, quinacridones available from DuPont under the tradename Monastral Red, Monastral Violet and Monastral Red Y, substituted 2,4-diamino-triazines disclosed in U.S. Pat. No. 3,442,781, and polynuclear aromatic quinones available from Allied Chemical Corporation under the tradename Indofast Double Scarlet, Indofast Violet Lake B, Indofast Brilliant Scarlet and Indofast Orange. Other examples of charge generator layers are disclosed in U.S. Pat. No. 4,265,990, U.S. Pat. No. 4,233,384, U.S. Pat. No. 4,471,041, U.S. Pat. No. 4,489,143, U.S. Pat. No. 4,507,480, U.S. Pat. No. 4,306,008, U.S. Pat. No. 4,299,897, U.S. Pat. No. 4,232,102, U.S. Pat. No. 4,233,383, U.S. Pat. No. 4,415,639 and U.S. Pat. No. 4,439,507. The disclosures of these patents are incorporated herein by reference in their entirety.

Any suitable inactive resin binder material may be employed in the charge generator layer. Typical organic resinous binders include polycarbonates, acrylate polymers, vinyl polymers, cellulose polymers, polyesters, polysiloxanes, polyamides, polyurethanes, epoxies, and the like. Many organic resinous binders are disclosed, for example, in U.S. Pat. No. 3,121,006 and U.S. Pat. No. 4,439,507, the entire disclosures of which are incorporated herein by reference. Organic resinous polymers may be block, random or alternating copolymers. The photogenerating composition or pigment is present in the resinous binder composition in various amounts. When using an electrically inactive or insulating resin, it is essential that there be particle-to-particle contact between the photoconductive particles. This necessitates that the photoconductive material be present in an amount of at least about 15 percent by volume of the binder layer with no limit on the maximum amount of photoconductor in the binder layer. If the matrix or binder comprises an active material, e.g. poly-N-vinylcarbazole, a photoconductive material need only to comprise about 1 percent or less by volume of the binder layer with no limitation on the maximum amount of photoconductor in the binder layer. Generally for generator layers containing an electrically active matrix or binder such as polyvinyl carbazole or poly(hydroxyether), from about 5 percent by volume to about 60 percent by volume of the photogenerating pigment is dispersed in about 40 percent by volume to about 95 percent by volume of binder, and preferably from about 7 percent to about 30 percent by volume of the photogenerating pigment is dispersed in from about 70 percent by volume to about 93 percent by volume of the binder The specific proportions selected also depends to some extent on the thickness of the generator layer.

The thickness of the photogenerating binder layer is not particularly critical. Layer thicknesses from about 0.05 micrometer to about 40.0 micrometers have been found to be satisfactory. The photogenerating binder layer containing photoconductive compositions and/or pigments, and the resinous binder material preferably ranges in thickness of from about 0.1 micrometer to about 5.0 micrometers, and has an optimum thickness of from about 0.3 micrometer to about 3 micrometers for best light absorption and improved dark decay stability and mechanical properties.

Other typical photoconductive layers include amorphous or alloys of selenium such as selenium-arsenic, selenium-tellurium-arsenic, selenium-tellurium, and the like.

The relatively thick active charge transport layer should have a thermal contraction coefficient substantially identical to the thermal contraction coefficient of the supporting layer. Satisfactory results may be achieved when the difference in thermal contraction coefficient between the substrate layer and the charge transport layer is between about $-2\times10^{-5}/°$ C. and about $+2\times10^{-5}/°$ C. Preferably, the difference in thermal contraction coefficient between the substrate layer and the charge transport layer is between about $-1\times10^{-5}/°$ C. and about $+1\times10^{-5}/°$ C. Optimum results are achieved when the difference in thermal contraction coefficients between the substrate layer and the charge transport layer is between about $-0.5\times10^{-5}/°$ C. and about $+0.5\times10^{-5}/°$ C. The charge transport layer should also be capable of supporting the injection of photo-generated holes and electrons from the charge transport layer and allowing the transport of these holes or electrons through the charge transport layer to selectively discharge the surface charge. The active charge transport layer not only serves to transport holes or electrons, but also protects the photoconductive layer from abrasion or chemical attack and therefor extends the operating life of the photoreceptor imaging member. The charge transport layer should exhibit negligible, if any, discharge when exposed to a wavelength of light useful in xerography, e.g. 4000 Angstroms to 8000 Angstroms. Therefore, the charge transport layer is substantially transparent to radiation in a region in which the photoconductor is to be used. Thus, the active charge transport layer is a substantially non-photoconductive material which supports the injection of photogenerated holes from the generation layer. The active transport layer is normally transparent when exposure is is effected through the active layer to ensure that most of the incident radiation is utilized by the underlying charge carrier generator layer for efficient photogeneration. When used with a transparent substrate, imagewise exposure may be accomplished through the substrate with all light passing through the substrate. In this case, the active transport material need not be absorbing in the wavelength region of use. The charge transport layer in conjunction with the generation layer in the instant invention is a material which is an insulator to the extent that an electrostatic charge placed on the transport layer is not conductive in the absence of illumination, i.e. a rate sufficient to prevent the formation and retention of an electrostatic latent image thereon.

Polymers having the capability of transporting holes contain repeating units of a polynuclear aromatic hydrocarbon which may also contain heteroatoms such as for example, nitrogen, oxygen or sulfur. Typical polymers include poly-N-vinylcarbazole; poly-1-vinylpyrene; poly-9-vinylanthracene; polyacenaphthalene; poly-9-(4-pentenyl)-carbazole; poly-9-(5-hexyl)-carbazole; polymethylene pyrene; poly-1-(pyrenyl)-butadiene; N-substituted polymeric acrylic acid amides of pyrene; the polymeric reaction product of N,N'-diphenyl N,N'bis (3-hydroxy phenyl){1,1' biphenyl}-4,4'diamine and diethylene glycol bischloroformate, and the like.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

Preferred electrically active layers comprise an electrically inactive resin material, e.g. a polycarbonate, polystyrene or polyether carbonate made electrically active by the addition of one or more of the following compounds poly-N-vinylcarbazole; poly-1-vinylpyrene; poly-9-vinylanthracene; polyacenaphthalene; poly-9-(4-pentenyl)-carbazole; poly-9-(5-hexyl)-carbazole; polymethylene pyrene; poly-1-(pyrenyl)-butadiene; N-substituted polymeric acrylic acid amides of pyrene; N,N'-diphenyl-N,N'-bis(phenylmethyl)-[1,1'-biphenyl]-4,4'-diamine; N,N'-diphenyl-N,N'-bis(3-methylphenyl)-2,2'-dimethyl-1,1'-biphenyl-4,4'-diamine and the like.

An especially preferred transport layer employed in one of the two electrically operative layers in the multilayer photoconductor of this invention comprises from about 25 to about 75 percent by weight of at least one charge transporting aromatic amine compound, and about 75 to about 25 percent by weight of a polymeric film forming resin in which the aromatic amine is soluble.

The charge transport layer forming mixture preferably comprises an aromatic amine compound of one or more compounds having the general formula:

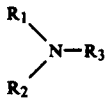

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms. The substituents should be free form electron withdrawing groups such as $NO_2$ groups, CN groups, and the like. Typical aromatic amine compounds that are represented by this structural formula include:

I. Triphenyl amines such as:

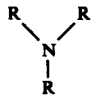

II. Bis and polytriarylamines such as:

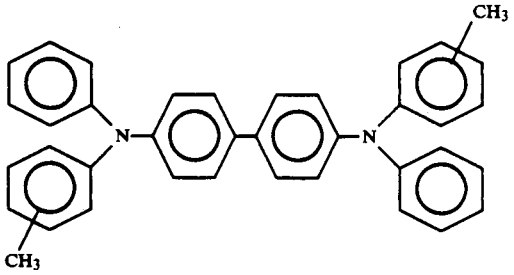

III. Bis arylamine ethers such as:

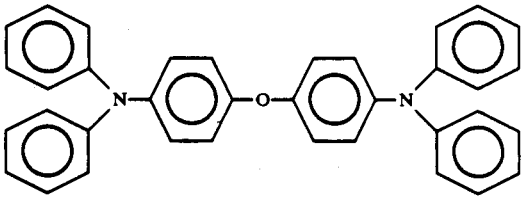

IV. Bis alkyl-arylamines such as:

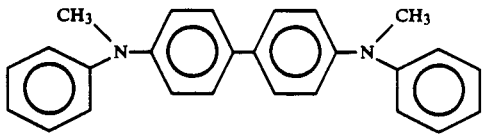

A preferred aromatic amine compound has the general formula:

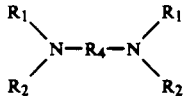

wherein $R_1$, and $R_2$ are defined above and $R_4$ is selected from the group consisting of a substituted or unsubstituted biphenyl group, diphenyl ether group, alkyl group having from 1 to 18 carbon atoms, and cycloaliphatic group having from 3 to 12 carbon atoms. The substituents should be free form electron withdrawing groups such as $NO_2$ groups, CN groups, and the like.

Excellent results in controlling dark decay and background voltage effects have been achieved when the imaging members comprising a charge generation layer comprise a layer of photoconductive material and a contiguous charge transport layer of a polycarbonate resin material having a molecular weight of from about 20,000 to about 120,000 having dispersed therein from about 25 to about 75 percent by weight of one or more diamine compounds having the general formula:

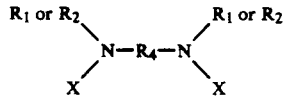

wherein $R_1$, $R_2$, and $R_4$ are defined above and X is selected from the group consisting of an alkyl group having from 1 to about 4 carbon atoms and chlorine, the photoconductive layer exhibiting the capability of photogeneration of holes and injection of the holes and the charge transport layer being substantially non-absorbing in the spectral region at which the photoconductive layer generates and injects photogenerated holes but being capable of supporting the injection of photogenerated holes from the photoconductive layer and transporting said holes through the charge transport layer.

Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl) phenylmethane; 4'-4''-bis(diethylamino)-2', 2''-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'biphenyl]-4,4'-diamine, N,N'diphenyl-N,N'-bis(3''-methylphenyl)-(1,1'-biphenyl)-4,4'-diamine, and the like dispersed in an inactive resin binder.

Any suitable inactive resin binder soluble in a suitable solvent may be employed in the process of this invention. Typical inactive resin binders soluble in solvents include polycarbonate resins such as poly(4,4'isopropylidenediphenyl carbonate) and poly [1,1-cyclohexanebis(4-phenyl)carbonate], polystyrene resins polyether carbonate resins, 4,4'cyclohexilidene diphenyl polycarbonate, polyarylate, and the like. Molecular weights can vary from about 20,000 to about 1,500,000.

The preferred electrically inactive resin materials are polycarbonate resins have a molecular weight from about 20,000 to about 100,000, more preferably from about 50,000 to about 100,000. The materials most preferred as the electrically inactive resin material is poly(4,4'-dipropylidene-diphenylene carbonate) with a molecular weight of from about 35,000 to about 40,000 (available as Lexan 145 from General Electric Company); poly(4,4'-isopropylidene-diphenylene carbonate) with a molecular weight of from about 40,000 to about 45,000 (available as Lexan 141 from the General Electric Company); a polycarbonate resin having a molecular weight of from about 50,000 to about 100,000, (available as Makrolon from Farbenfabricken Bayer A.G.) and a polycarbonate resin having a molecular weight of from about 20,000 to about 50,000 (available as Merlon from Mobay Chemical Company). Methylene chloride solvent is a desirable component of the charge transport layer coating mixture for adequate dissolving of all the components and for its low boiling point. Layers comprising such polycarbonate resins having a $T_g \sim 81°$ C. and loaded with about 50 percent by weight of an electrically active diamine compound, based on the total weight of the layer, have a thermal contraction coefficient between about $5.6 \times 10^{-5}/°$ C. and about $7.5 \times 10^{-5}/°$ C.

In all of the above charge transport layers, the activating compound which renders the electrically inactive polymeric material electrically active should be present in amounts of from about 15 to about 75 percent by weight.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 micrometers to about 100 micrometers, but thicknesses outside this range can also be used.

The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to 200:1 and in some instances as great as 400:1.

Optionally, a thin overcoat layer may also be utilized to improve resistance to abrasion. These overcoating layers may comprise organic polymers or inorganic polymers that are electrically insulating or slightly semi-conductive.

In a typical electrophotographic imaging member in which the photoreceptor side of the imaging member contains a transport layer of polycarbonate resin and active diamine transport material having a thickness range of from about 24 micrometers to about 31 micrometers, a polyethersulfone substrate to provide mechanical and/or strength and rigidity of the device, satisfactory results may be achieved when the polyethersulfone substrate has a thickness range of between about 2 mils (51) micrometers and about 7 mils (178) micrometers. More preferably, the polyethersulfone substrate has a thickness range of between about 3 mils (76 micrometers) and about 6 mils (152 micrometers). For optimum mechanical performance and flatness, the polyethersulfone substrate has a thickness range of between about 3.5 mils (90 micrometers) and about 4.5 mils (114 micrometers). These imaging members have a difference in thermal contraction coefficient of between about $-2 \times 10^{-5}/°$ C. and about $+2 \times 10^{-5}/°$ C.

Generally, satisfactory results may be achieved when the polymeric substrates suitable for the photoreceptors of this invention have a thermal contraction coefficient of about 4.5 to $8.5 \times 10^{-5}/°$ C. [$(-2.0$ to $+2.0) \times 10^{-5}/°$ C.]in the temperature range of between about 0° C. and about 150° C. More preferably, the polymeric substrates have a thermal contraction of about 5.5 to $7.5 \times 10^{-5}/°$ C. [$(-1.0$ to $+1.0) \times 10^{-5}/°$ C.]. For optimum flatness, the polymeric substrates have a thermal contraction coefficient of about 6.0 to $7.0 \times 10^{-5}/°$ C. [$(-0.5$ to $0.5) \times 10^{-5}/°$ C.].

The photoreceptor of this invention reduces the number of coating layers required in the final photoreceptor product. The number of steps and costs for fabricating the photoreceptor of this invention is also reduced. Moreover, the rate of fabrication and product yield are increased. Also, the common phenomenon of transport layer internal stress build-up is removed, thereby prolonging mechanical service life. In addition, photoreceptor deformation is eliminated. Further, adhesion between the substrate and overlying layers is improved. The coefficient of surface contact friction between the polyethersulfone substrate and transport layer is also lowered (e.g. 0.8 compared to 2.8 for conventional polycarbonate anti-curl backing layers against an adjacent transport layer). Furthermore, the coefficient of surface ocntact friction between polyethersulfone and polyethersulfone in a photoreceptor belt product (i.e. where the inside surfaces of a belt contact each other) is lowered (0.4 compared to 3.5 for conventional polycarbonate anti-curl backing layer surfaces where the inside surfaces of a belt contact each other). The reduced coefficient of friction values for the improved photoreceptor prevents slowing down of the production line due to jamming problems and permits the use of rolls of photoreceptors that will not otherwise run in belt making machines. Polyethersulfone substrates can maintain a high coefficient of friction against a belt module drive roll to ensure positive and reliable photoreceptor belt driving during machine operation. In addition, expensive and elaborate packaging is rendered unnecessary for photoreceptor belt products of this invention because the polyethersulfone substrate may be allowed to touch itself without causing the layers coated on the substrate to pucker and form dimples and render the photoreceptor useless. Other benefits are realized relating to cost and winding of the photoreceptor roll. In addition, this invention reduces print defects by markedly extending the cycling resistance to curling of the photoreceptor.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A photoconductive imaging member was prepared by providing a titanium coated polyethylene terephthalate(Melinex 442, available from ICI Americas, Inc.) substrate having a thickness of 3 mil (76.2 micrometers), a width of 21 cm and a length of 28 cm, and applying thereto, using a Bird applicator, a solution containing 2.592 gm 3-aminopropyltriethoxysilane, 0.784 gm acetic acid, 180 gm of 190 proof denatured alcohol and 77.3 gm heptane. This layer was then allowed to dry for 5 minutes at room temperature and 10 minutes at 135° C. in a forced air oven. The resulting blocking layer had a dry thickness of 0.01 micrometer.

An adhesive interface layer was then prepared by the applying to the blocking layer a coating having a wet thickness of 0.5 mil and containing 0.5 percent by weight based on the total weight of the solution of polyester adhesive (DuPont 49,000, available from E. I. du Pont de Nemours & Co.) in a 70:30 volume ratio mixture of tetrahydrofuran/cyclohexanone with a Bird applicator. The adhesive interface layer was allowed to dry for 1 minute at room temperature and 10 minutes at 100° C. in a forced air oven. The resulting adhesive interface layer had a dry thickness of 0.05 micrometer.

The adhesive interface layer was thereafter coated with a photogenerating layer containing 7.5 percent by volume trigonal Se, 25 percent by volume N,N'-diphenyl-N,N'-bis(3-methylphenyl)-1,1'-biphenyl-4,4'-diamine, and 67.5 percent by volume polyvinylcarbazole. This photogenerating layer was prepared by introducing 0.8 gram polyvinyl carbazole and 14 ml of a 1:1 volume ratio of a mixture of tetrahydrofuran and toluene into a 2 oz. amber bottle. To this solution was added 0.8 gram of trigonal selenium and 100 grams of ⅛ inch diameter stainless steel shot. This mixture was then placed on a ball mill for 72 to 96 hours. Subsequently, 5 grams of the resulting slurry were added to a solution of 0.36 gm of polyvinyl carbazole and 0.20 gm of N,N'-diphenyl-N,N'-bis(3-methylphenyl)-1,1'-biphenyl-4,4'-diamine in 7.5 ml of 1:1 volume ratio of tetrahydrofuran/toluene. This slurry was then placed on a shaker for 10 minutes. The resulting slurry was thereafter applied to the adhesive interface with a Bird applicator to form a layer having a wet thickness of 0.5 mil. The layer was dried at 135° C. for 5 minutes in a forced air oven to form a dry thickness photogenerating layer having a thickness of 2.0 microns.

This photogenerator layer was overcoated with a charge transport layer. The charge transport layer was prepared by introducing into an amber glass bottle in a weight ratio of 1:1N,N'-diphenyl-N,N'-bis(3-methylphenyl)-1,1'-biphenyl-4,4'-diamine and Makrolon R, a polycarbonate resin having a molecular weight of from about 50,000 to 100,000 commercially available from Larbensabricken Bayer A.G. The resulting mixture was dissolved in by weight methylene chloride to form a solution containing 15 percent by weight solids. This solution was applied on the photogenerator layer using a Bird applicator to form a coating which upon drying had a thickness of 24 microns. During this coating process the humidity was equal to or less than 15 percent. The resulting photoreceptor device containing all of the above layers was annealed at 135° C. in a forced air oven for 5 minutes and thereafter cooled to ambient room temperature.

No anti-curl coating was applied to the substrate. The substrate had a of thermal contraction coefficient of $1.7\times10^{-5}/°$ C. and the charge transport layer had a thermal contraction coefficient of $6.5\times10^{-5}/°$ C. While unrestrained, the opposite edges of the resulting photoreceptor curled upwardly toward the coated side to form a 1.5 inch (3.8 cm) diameter roll.

EXAMPLE II

A photoconductive imaging member was prepared by providing a titanium coated polyethylene terephthalate(Melinex 442, available from ICI Americas, Inc.) substrate having a thickness of 3 mil (76.2 micrometers) micrometers, a width of 21 cm and a length of 28 cm, and applying thereto, using a Bird applicator, a solution containing 2.592 gm 3-aminopropyltriethoxysilane, 0.784 gm acetic acid, 180 gm of 190 proof denatured alcohol and 77.3 gm heptane. This layer was then allowed to dry for 5 minutes at room temperature and 10 minutes at 135° C. in a forced air oven. The resulting blocking layer had a dry thickness of 0.01 micrometer.

An adhesive interface layer was then prepared by the applying to the blocking layer a coating having a wet thickness of 0.5 mil and containing 0.5 percent by weight based on the total weight of the solution of polyester adhesive (DuPont 49,000, available from E. I. du Pont de Nemours & Co.) in a 70:30 volume ratio mixture of tetrahydrofuran/cyclohexanone with a Bird applicator. The adhesive interface layer was allowed to dry for 1 minute at room temperature and 10 minutes at 100° C. in a forced air oven. The resulting adhesive interface layer had a dry thickness of 0.05 micrometer.

The adhesive interface layer was thereafter coated with a photogenerating layer containing 7.5 percent by volume trigonal Se, 25 percent by volume N,N'-diphenyl-N,N'-bis(3percent by volume N,N'-diphenyl-N,N'-bis(3-methylphenyl)-1,1'-biphenyl-4,4'-diamine, and 67.5 percent by volume polyvinylcarbazole. This photogenerating layer was prepared by introducing 0.8 gram polyvinyl carbazole and 14 ml of a 1:1 volume ratio of a mixture of tetrahydrofuran and toluene into a 2 oz. amber bottle. To this solution was added 0.8 gram of trigonal selenium and 100 grams of ⅛inch diameter stainless steel shot. This mixture was then placed on a ball mill for 72 to 96 hours. Subsequently, 5 grams of the resulting slurry were added to a solution of 0.36 gm of polyvinyl carbazole and 0.20 gm of N,N'-diphenyl-N,N'-bis(3-methylphenyl)-1,1'-biphenyl-4,4'-diamine in 7.5 ml of 1:1 volume ratio of tetrahydrofuran/toluene. This slurry was then placed on a shaker for 10 minutes. The resulting slurry was thereafter applied to the adhesive interface with a Bird applicator to form a layer having a wet thickness of 0.5 mil. The layer was dried at 135° C. for 5 minutes in a forced air oven to form a dry thickness photogenerating layer having a thickness of 2.0 microns.

This photogenerator layer was overcoated with a charge transport layer. The charge transport layer was prepared by introducing into an amber glass bottle in a weight ratio of 1:1 N,N'-diphenyl-N,N'-bis(3-methylphenyl)-1,1'-biphenyl-4,4'-diamine and Makrolon R, a polycarbonate resin having a molecular weight of from about 50,000 to 100,000 commercially available from Larbensabricken Bayer A.G. The resulting mixture was dissolved in by weight methylene chloride to form a solution containing 15 percent by weight solids. This solution was applied on the photogenerator layer using a Bird applicator to form a coating which upon drying had a thickness of 24 microns. During this coating process the humidity was equal to or less than 15 percent. The resulting photoreceptor device containing all of the above layers was annealed at 135° C. in a forced air oven for 5 minutes and thereafter cooled to ambient room temperature.

An anti-curl coating was prepared by combining 8.81 g of polycarbonate resin (Makrolon 5705, available from Bayer AG), 0.09 g of polyester resin (Vitel PE 100, available from Goodyear Tire and Rubber Co.), and 91.1 g of methylene chloride in a amber glass container to form a coating solution containing 8.9 percent solids. The container was covered tightly and placed on a roll mill for about 24 hours until the polycarbonate and polyester were dissolved in the methylene chloride. The anti-curl coating solution was applied to the rear surface (side opposite the photogenerator layer and charge transport layer) of the photoconductive imaging member by a Bird applicator and dried at 135° C. for about 5 minutes to produce a dried film having a thickness of 14 micrometers. The substrate had a thermal contraction coefficient of $1.7\times10^{-5}$/° C. and the charge transport layer had a thermal contraction coefficient of $6.5\times10^{-5}$/° C. While unrestrained, the resulting photoreceptor remained flat.

EXAMPLE III

A photoconductive imaging member was prepared by providing a titanium coated polyether sulfone (Stabor S 100, available from ICI Americas, Inc.) substrate having a thickness of 4 mils (101.6 micrometers), a width of 21 cm and a length of 28 cm, and applying thereto, using a Bird applicator, a solution containing 2.592 gm 3-aminopropyltriethoxysilane, 0.784 gm acetic acid, 180 gm of 190 proof denatured alcohol and 77.3 gm heptane. This layer was then allowed to dry for 5 minutes at room temperature and 10 minutes at 135° C. in a forced air oven. The resulting blocking layer had a dry thickness of 0.01 micrometer.

An adhesive interface layer was then prepared by the applying to the blocking layer a coating having a wet thickness of 0.5 mil and containing 0.5 percent by weight based on the total weight of the solution of polyester adhesive (DuPont 49,000, available from E. I. du Pont de Nemours & Co.) in a 70:30 volume ratio mixture of tetrahydrofuran/cyclohexanone with a Bird applicator. The adhesive interface layer was allowed to dry for 1 minute at room temperature and 10 minutes at 100° C. in a forced air oven. The resulting adhesive interface layer had a dry thickness of 0.05 micrometer.

The adhesive interface layer was thereafter coated with a photogenerating layer containing 7.5 percent by volume trigonal Se, 25 percent by volume N,N'-diphenyl-N,N'-bis(3-methylphenyl)-1,1'-biphenyl-4,4'-diamine, and 67.5 percent by volume polyvinylcarbazole. This photogenerating layer was prepared by introducing 0.8 gram polyvinyl carbazole and 14 ml of a 1:1 volume ratio of a mixture of tetrahydrofuran and toluene into a 2 oz. amber bottle. To this solution was added 0.8 gram of trigonal selenium and 100 grams of ⅛ inch diameter stainless steel shot. This mixture was then placed on a ball mill for 72 to 96 hours. Subsequently, 5 grams of the resulting slurry were added to a solution of 0.36 gm of polyvinyl carbazole and 0.20 gm of N,N'-diphenyl-N,N'-bis(3-methylphenyl)-1,1'-biphenyl-4,4'-diamine in 7.5 ml of 1:1 volume ratio of tetrahydrofuran/toluene. This slurry was then placed on a shaker for 10 minutes. The resulting slurry was thereafter applied to the adhesive interface with a Bird applicator to form a layer having a wet thickness of 0.5 mil. The layer was dried at 135° C. for 5 minutes in a forced air oven to form a dry thickness photogenerating layer having a thickness of 2.0 microns.

This photogenerator layer was overcoated with a charge transport layer. The charge transport layer was prepared by introducing into an amber glass bottle in a weight ratio of 1:1 N,N'-diphenyl-N,N'-bis(3-methylphenyl)-1,1'-biphenyl-4,4'-diamine and Makrolon R, a polycarbonate resin having a molecular weight of from about 50,000 to 100,000 commercially available from Larbensabricken Bayer A. G. The resulting mixture was dissolved in by weight methylene chloride to form a solution containing 15 percent by weight solids. This solution was applied on the photogenerator layer using a Bird applicator to form a coating which upon drying had a thickness of 24 microns. During this coating process the humidity was equal to or less than 15 percent. The resulting photoreceptor device containing all of the above layers was annealed at 135 ° C. in a forced air oven for 5 minutes and thereafter cooled to ambient room temperature.

No anti-curl coating was applied to the substrate. The substrate had a thermal contraction coefficient of $6.0\times10^{-5}$/° C. and the charge transport layer had a thermal contraction coefficient of $6.5\times10^{-5}$/° C.

During conventional fabrication processes for conventional multilayered photoreceptors such as that described in Example I, it is hypothesized that when a biaxially oriented polyethylene terephthalate (PET) substrate previously coated with a generator layer is coated with a polycarbonate charge transport layer (CTL) and cooled to ambient room temperature, the phenomenon of curling during cooling can be divided into three subsequent steps: (1) Between the temperature range of 135 ° C. and 81 ° C. (the $T_g$ of the CTL), the CTL is a highly viscous liquid such that the thermal and volume contraction stresses developed in the film are spontaneously dissipated by visco-molecular motion in the CTL; (2) Solidification of CTL occurs as the film cools to the $T_g$ of the CTL. At this point, the CTL has lost its liquid characteristic and transforms itself into a solid system; and (3) Further cooling from the $T_g$ down to ambient room temperature (e.g. 25 ° C.) results in a CTL internal stress/strain build-up due to a thermal contraction mismatch between the CTL and the PET substrate. The calculations for internal strain build-up in the CTL set forth as follows:

*CTL* strain due to contraction between 82° C. and 25° C. =

(Total thermal contraction of *CTL* − Total thermal contraction of *PET*) = $[(6.5\times10^{-5} - 1.7\times10^{-5})/°C.](81° C. - 25° C.) =$ 0.274%

This internal strain is believed responsible for the observed upward curling. At this point, the photoreceptor of the type illustrated in Example I, without any externally imposed restriction, will curl up freely into a small diameter roll. Since photoreceptor curling is undesirable, a subsequent anti-curl back coating is usually applied to the back side of the photoreceptor (of the type illustrated in Example II) to counteract CTL contraction effect and to maintain the photoreceptor in a flat configuration.

The total photoreceptor surface strain of 2 types of multilayered photoreceptors [(as illustrated in Example II, with CTL internal stress/strain build-up of 0.274 percent due to a thermal contraction mismatch between the CTL and the PET substrate) compared to (with polyether sulfone substrate layer, as illustrated in Example III, having a thermal contraction coefficient substantially identical to the thermal contraction coefficient of the CTL so that there is no stress/strain mismatch)] when bent over a belt support roller under machine operating conditions can be summarized by a simple equation below:

$$\text{Total photoreceptor surface strain} = \epsilon_t + \epsilon_c + \epsilon_T + \epsilon_i + \epsilon_b \quad [1]$$

(tension + creep + temp + internal + bending)

The strain contributions from the effects of belt tension (t), creep (c), and temperature (T) are at least one order of magnitude smaller than the internal (i) and bending (b) strains. Therefore, these components can be neglected to simplify calculations. Thus, equation [1] reduces to:

$$\text{Total photoreceptor surface strain} = \epsilon_i + \epsilon_b \quad [2]$$

The mathematic model to describe the photoreceptor bending strain can be presented as follows:

$$\epsilon_b = t/(2R + t) \quad [3]$$

where t is the thickness of a photoreceptor

R is the radius of a belt support roller

As it has been shown above, the internal strain build-up in a typical multilayered photoreceptor was 0.274 percent. Substituting this value along with equation [3] into equation [2]

$$\text{Total photoreceptor surface strain} = 0.274\% + t/(2R + t) \quad [4]$$

Equation [4] describes the interrelationship between total photoreceptor surface strain, internal strain ($\epsilon_i$), photorecptor thickness (t), and the radius (R) of a roller over which the belt was bent during belt cycling. In contrast to the photoreceptor bearing an anti-curl back coating, the anti-curl back coating free photoreceptor of this invention has zero internal strain, therefore the total photoreceptor surface strain is equal to the bending strain. Equation (4) reduces to:

$$\text{Total photoreceptor surface strain} = t/(2R + t) \quad [5]$$

Utilizing equations [4)] and [5], the total photoreceptor surface strains for these 2 types of multilayered photoreceptors over a series of belt module rollers are theoretically calculated and listed in Table 2 below:

TABLE 2

Theoretical Calculations of the Total Surface Strain for a Typical Multilayered Photoreceptor and Anti-curl back Coating Free Photoreceptor of This Invention Bent Over a Roller With a 180° Wrap Angle

| Dia. of | TOTAL PHOTORECEPTOR SURFACE STRAIN (%) | | | | | | |
|---|---|---|---|---|---|---|---|
| Roller | 2 cm | 2.5 cm | 3.8 cm | 5.1 cm | 6.4 cm | 7.6 cm | 8.9 cm |
| Photoreceptor | | | | | | | |
| Of Example II | 0.863 | 0.745 | 0.588 | 0.509 | 0.462 | 0.431 | 0.408 |
| Of Example III | 0.647 | 0.518 | 0.345 | 0.258 | 0.206 | 0.172 | 0.147 |

As seen in Table 2, the total photoreceptor surface strain over a 2 cm diameter roll for the anti-curl back coating free photoreceptor of this invention is only 75 percent of that for a typical multilayered photoreceptor. This represents a 25 percent strain reduction over a small diameter roll. However, the photoreceptor surface strain reduction becomes more substantial as the size of the roller is increased. When bending over an 8.9 cm diameter roll, the calculated photoreceptor strain reduction for the anti-curl back coating free photoreceptor of this invention reaches a value of 64 percent. The calculated results shown in Table 2 clearly teach that the dynamic - fatigued cracking life of a typical multilayered photoreceptor could be substantially extended by the anti-curl back coating free photoreceptor of this invention.

EXAMPLE IV

Sample sections prepared from the photoreceptors of Examples II and III were bent over a 1.9 cm diameter roller with a 180° wrap angle and 179 g/cm tension for 3 days at 41 ° C. at ambient room humidity. The sample sections were 6 cm wide and 12 cm long. The sample sections were then removed from the roller and placed on a flat table, the sample section prepared as described in Example II assumed a curvature of a tube having a diameter of about 10 cm whereas the sample section prepared as described in Example III remained flat.

EXAMPLE V

A web section prepared from the photoreceptor of Example II was welded into a belt having a circumference of about 123 cm and cycled in a Xerox 1075 copying machine for about 100,000 cycles. The belt was then removed from the machine and examined. The edges of the photoreceptor curved away from the center of the belt because about 50 percent by weight of the anticurl layer was worn away.

EXAMPLE VI

A photoconductive imaging member was prepared by providing a titanium coated polyvinyl fluoride (Tedlar, available from ICI Inc.) substrate having a thickness of 3 mils and applying thereto, using a Bird applicator, a solution containing 2.592 gm 3-aminopropyltriethoxysilane, 0.784 gm acetic acid, 180 gm of 190 proof denatured alcohol and 77.3 gm heptane. This layer was then allowed to dry for 5 minutes at room temperature and 10 minutes at 135 ° C. in a forced air oven. The resulting blocking layer had a dry thickness of 0.01 micrometer.

An adhesive interface layer was then prepared by the applying to the blocking layer a coating having a wet thickness of 0.5 mil and containing 0.5 percent by weight based on the total weight of the solution of polyester adhesive (DuPont 49,000, available from E. I. du Pont de Nemours & Co.) in a 70:30 volume ratio mixture of tetrahydrofuran/cyclohexanone with a Bird applicator. The adhesive interface layer was allowed to dry for 1 minute at room temperature and 10 minutes at 100° C. in a forced air oven. The resulting adhesive interface layer had a dry thickness of 0.05 micrometer.

The adhesive interface layer was thereafter coated with a photogenerating layer containing 7.5 percent by volume trigonal Se, 25 percent by volume N,N'-diphenyl-N,N'-bis(3-methylphenyl)-1,1'-biphenyl-4,4'-diamine, and 67.5 percent by volume polyvinylcarbazole. This photogenerating layer was prepared by introducing 0.8 gram polyvinyl carbazole and 14 ml of a 1:1 volume ratio of a mixture of tetrahydrofuran and toluene into a 2 oz. amber bottle. To this solution was added 0.8 gram of trigonal selenium and 100 grams of ⅛ inch diameter stainless steel shot. This mixture was then placed on a ball mill for 72 to 96 hours. Subsequently, 5 grams of the resulting slurry were added to a solution of 0.36 gm of polyvinyl carbazole and 0.20 gm of N,N'-diphenyl-N,N'-bis(3-methylphenyl)-1,1'-biphenyl-4,4'-diamine in 7.5 ml of 1:1 volume ratio of tetrahydrofuran/toluene. This slurry was then placed on a shacker for 10 minutes. The resulting slurry was thereafter applied to the adhesive interface with a Bird applicator to form a layer having a wet thickness of 0.5 mil. The layer was dried at 135 ° C. for 5 minutes in a forced air oven to form a dry thickness photogenerating layer having a thickness of 2.0 microns.

This photogenerator layer was overcoated with a charge transport layer. The charge transport layer was prepared by introducing into an amber glass bottle in a weight ratio of 1:1 N,N'-diphenyl-N,N'-bis(3-methylphenyl)-1,1'-biphenyl-4,4'-diamine and Makrolon R, a polycarbonate resin having a molecular weight of from about 50,000 to 100,000 commercially available from Larbensabricken Bayer A. G. The resulting mixture was dissolved in methylene chloride to form a solution containing 15 percent by weight solids. This solution was applied on the photogenerator layer using a Bird applicator to form a coating which upon drying had a thickness of 25 microns. During this coating process the humidity was equal to or less than 15 percent. The resulting photoreceptor device containing all of the above layers was annealed at 135 ° C. in a forced air oven for 5 minutes. No anticurl coating was applied to the substrate. The substrate had a thermal contraction coefficient of $7.0 \times 10^{-5}$/° C. and the charge transport layer had a thermal contraction coefficient of $6.5 \times 10^{-5}$/°C.

EXAMPLE VII

A photoconductive imaging member was prepared by providing a titanium coated amorphous polyethylene terephthalate polyester (Melinar, available from ICI America, Inc.) substrate having a thickness of 3 mils and applying thereto, using a Bird applicator, a solution containing 2.592 gm 3-aminopropyltriethoxysilane, 0.784 gm acetic acid, 180 gm of 190 proof denatured alcohol and 77.3 gm heptane. This layer was then allowed to dry for 5 minutes at room temperature and 10 minutes at 135 ° C. in a forced air oven. The resulting blocking layer had a dry thickness of 0.01 micrometer.

An adhesive interface layer was then prepared by the applying to the blocking layer a coating having a wet thickness of 0.5 mil and containing 0.5 percent by weight based on the total weight of the solution of polyester adhesive (DuPont 49,000, available from E. I. du Pont de Nemours & Co.) in a 70:30 volume ratio mixture of tetrahydrofuran/cyclohexanone with a Bird applicator. The adhesive interface layer was allowed to dry for 1 minute at room temperature and 10 minutes at 100° C. in a forced air oven. The resulting adhesive interface layer had a dry thickness of 0.05 micrometer.

The adhesive interface layer was thereafter coated with a photogenerating layer containing 7.5 percent by volume trigonal Se, 25 percent by volume N,N'-diphenyl-N,N'-bis(3-methylphenyl)-1,1'-biphenyl-4,4'-diamine, and 67.5 percent by volume polyvinylcarbazole. This photogenerating layer was prepared by introducing 0.8 gram polyvinyl carbazole and 14 ml of a 1:1 volume ratio of a mixture of tetrahydrofuran and toluene into a 2 oz. amber bottle. To this solution was added 0.8 gram of trigonal selenium and 100 grams of ⅛ inch diameter stainless steel shot. This mixture was then placed on a ball mill for 72 to 96 hours. Subsequently, 5 grams of the resulting slurry were added to a solution of 0.36 gm of polyvinyl carbazole and 0.20 gm of N,N'-diphenyl-N,N'-bis(3-methylphenyl)-1,1'-biphenyl--4,4'-diamine in 7.5 ml of 1:1 volume ratio of tetrahydrofuran/toluene. This slurry was then placed on a shaker for 10 minutes. The resulting slurry was thereafter applied to the adhesive interface with a Bird applicator to form a layer having a wet thickness of 0.5 mil. The layer was dried at 135° C. for 5 minutes in a forced air oven to form a dry thickness photogenerating layer having a thickness of 2.0 microns.

This photogenerator layer was overcoated with a charge transport layer. The charge transport layer was prepared by introducing into an amber glass bottle in a weight ratio of 1:1 N,N'-diphenyl-N,N'-bis(3-methylphenyl)-1,1'-biphenyl-4,4'-diamine and Makrolon R, a polycarbonate resin having a molecular weight of from about 50,000 to 100,000 commercially available from Larbensabricken Bayer A. G. The resulting mixture was dissolved in methylene chloride to form a solution containing 15 percent by weight solids. This solution was applied on the photogenerator layer using a Bird applicator to form a coating which upon drying had a thickness of 25 microns. During this coating process the humidity was equal to or less than 15 percent. The resulting photoreceptor device containing all of the above layers was annealed at 135° C. in a forced air oven for 5 minutes. No anticurl coating was applied to the substrate. The substrate had a thermal contraction coefficient of $6.5 \times 10^{-5}$/° C. and the charge transport layer had a thermal contraction coefficient of $6.5 \times 10^{-5}$/°C.

EXAMPLE VIII

A photoconductive imaging member was prepared by providing a titanium coated polycarbonate (Makrofol, available from Mobay Chemical Corporation) substrate having a thickness of 3 mils and applying thereto, using a Bird applicator, a solution containing 2.592 gm 3-aminopropyltriethoxysilane, 0.784 gm acetic acid, 180 gm of 190 proof denatured alcohol and 77.3 gm heptane. This layer was then allowed to dry for 5 minutes at room temperature and 10 minutes at 135° C. in a forced air oven. The resulting blocking layer had a dry thickness of 0.01 micrometer.

An adhesive interface layer was then prepared by the applying to the blocking layer a coating having a wet thickness of 0.5 mil and containing 0.5 percent by weight based on the total weight of the solution of polyester adhesive (DuPont 49,000, available from E. I. du Pont de Nemours & Co.) in a 70:30 volume ratio mixture of tetrahydrofuran/cyclohexanone with a Bird applicator. The adhesive interface layer was allowed to dry for 1 minute at room temperature and 10 minutes at 100° C. in a forced air oven. The resulting adhesive interface layer had a dry thickness of 0.05 micrometer.

The adhesive interface layer was thereafter coated with a photogenerating layer containing 7.5 percent by volume trigonal Se, 25 percent by volume N,N'-diphenyl-N,N'-bis(3-methylphenyl)-1,1'-biphenyl-4,4'diamine, and 67.5 percent by volume polyvinylcarbazole. This photogenerating layer was prepared by introducing 0.8 gram polyvinyl carbazole and 14 ml of a 1:1 volume ratio of a mixture of tetrahydrofuran and toluene into a 2 oz. amber bottle. To this solution was added 0.8 gram of trigonal selenium and 100 grams of ⅛ inch diameter stainless steel shot. This mixture was then placed on a ball mill for 72 to 96 hours. Subsequently, 5 grams of the resulting slurry were added to a solution of 0.36 gm of polyvinyl carbazole and 0.20 gm of N,N'-diphenyl-N,N'-bis(3-methylphenyl)-1,1'-biphenyl-4,4'-diamine in 7.5 ml of 1:1 volume ratio of tetrahydrofuran/toluene. This slurry was then placed on a shaker for 10 minutes. The resulting slurry was thereafter applied to the adhesive interface with a Bird applicator to form a layer having a wet thickness of 0.5 mil. The layer was dried at 135° C. for 5 minutes in a forced air oven to form a dry thickness photogenerating layer having a thickness of 2.0 microns.

This photogenerator layer was overcoated with a charge transport layer. The charge transport layer was prepared by introducing into an amber glass bottle in a weight ratio of 1:1 N,N'-diphenyl-N,N'-bis(3-methylphenyl)-1,1'-biphenyl-4,4'-diamine and Makrolon R, a polycarbonate resin having a molecular weight of from about 50,000 to 100,000 commercially available from Larbensabricken Bayer A.G. The resulting mixture was dissolved in methylene chloride to form a solution containing 15 percent by weight solids. This solution was applied on the photogenerator layer using a Bird applicator to form a coating which upon drying had a thickness of 25 microns. During this coating process the humidity was equal to or less than 15 percent. The resulting photoreceptor device containing all of the above layers was annealed at 135° C. in a forced air oven for 5 minutes. No anticurl coating was applied to the substrate. The substrate had a thermal contraction coefficient of $6.5\times10^{-5}$/° C. and the charge transport layer had a thermal contraction coefficient of $6.5\times10^{-5}$/° C.

Although the invention has been described with reference to specific preferred embodiments, it is not intended to be limited thereto, rather those skilled in the art will recognize that variations and modifications may be made therein which are within the spirit of the invention and within the scope of the claims.

What is claimed:

1. A flexible electrophotographic imaging member comprising a flexible supporting substrate layer comprising polyethersulfone, said substrate layer being uncoated on one side and coated on the other side with an electrically conductive layer, an optional adhesive layer, a charge generator layer and a charge transport layer comprising a thermoplastic film forming polymer, said substate layer having a thermal contraction coefficient substantially identical to the thermal contraction coefficient of said charge transport layer.

2. A flat flexible electrophotographic imaging member according to claim 1 wherein said charge transport layer comprises polycarbonate.

3. A flat flexible electrophotographic imaging member according to claim 1 wherein said flexible supporting substrate layer has a thickness of between about 51 micrometers and about 178 micrometers and said charge transport layer comprises polycarbonate and has a thickness of between 24 micrometers and about 31 about micrometers.

4. A flexible electrophotographic imaging member according to claim 1 wherein said flexible supporting substrate layer has a thickness of between about 76 micrometers and about 152 micrometers and said charge transport layer comprises polycarbonate and has a thickness of between about 24 micrometers and about 31 micrometers.

5. A flexible electrophotographic imaging member according to claim 1 wherein said flexible supporting substrate layer has a thickness of between about 90 micrometers and about 114 micrometers and said charge transport layer comprises polycarbonate and has a thickness of between about 24 micrometers and about 31 micrometers.

6. A flexible electrophotographic imaging member according to claim 1 wherein the difference in thermal contraction coefficient between said substrate layer and said charge transport layer is between about $-2\times10^{-5}$/° C. and about $+2\times10^{-5}$/° C. in the temperature range of between about 0° C. and about 150° C.

7. A flexible electrophotographic imaging member according to claim 1 wherein the difference in thermal contraction coefficient between said substrate layer and said charge transport layer is between about $-1\times10^{-5}$/° C. and about $+1\times10^{-5}$/° C. in the temperature range of between about 0° C. and about 150° C. and said substrate layer has a linear thermal contraction coefficient range between about $5.6\times10^{-5}$/° C. and $7.5\times10^{-5}$/° C.

8. A flexible electrophotographic imaging member according to claim 1 wherein the difference in thermal contraction coefficient between said substrate layer and said charge transport layer is between about $-0.5\times10^{-5}$/° C. and about $+0.5\times10^{-5}$/° C. in the temperature range of between about 0° C. and about 150° C.

9. A flexible electrophotographic imaging member according to claim 6 wherein said charge transport layer comprises an organic polymer and an aromatic amine compound having the general formula:

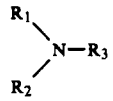

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms.

10. An electrophotographic imaging process comprising providing a flexible supporting substrate layer comprising polyethersulfone, an electrically conductive layer, an optional adhesive layer, a charge generator layer and a charge transport layer, said substrate layer having a thermal contraction coefficient substantially identical to the thermal contraction coefficient of said charge transport layer, forming an electrostatic latent image on said imaging member, forming a toner image on said imaging member in conformance with said electrostatic latent image and transfering said toner image to a receiving member.

11. An electrophotographic imaging process according to claim 10 comprising sliding said substrate layer against a stationary support member while forming said electrostatic latent image on said imaging surface, forming said toner image, and transferring said toner image to said receiving member.

12. An electrophotographic imaging process according to claim 10 wherein said charge transport layer comprises polycarbonate.

13. An electrophotographic imaging process according to claim 10 wherein said flexible supporting substrate layer has a thickness of between about 51 micrometers and about 178 micrometers and said charge transport layer comprises polycarbonate and has a thickness of between 24 micrometers and about 31 about micrometers.

14. An electrophotographic imaging process according to claim 10 wherein said flexible supporting substrate layer comprises polyethersulfone and has a thickness of between about 76 micrometers and about 152 micrometers and said charge transport layer comprises polycarbonate and has a thickness of between about 24 micrometers and about 31 micrometers.

15. An electrophotographic imaging process according to claim 10 wherein said flexible supporting substrate layer has a thickness of between about 90 micrometers and about 114 micrometers and said charge transport layer comprises polycarbonate and has a thickness of between about 24 micrometers and about 31 micrometers.

16. An electrophotographic imaging process according to claim 10 wherein the difference in thermal contraction coefficient between said substrate layer and said charge transport layer is between about $-2\times10-5/°$ C. and about $+2\times10-5/°$ C. in the temperature range of between about 0° C. and about 150° C.

17. An electrophotographic imaging process according to claim 10 wherein the difference in thermal contraction coefficient between said substrate layer and said charge transport layer is between about $-1\times10^{-5}/°$ C. and about $+1\times10^{-5}/°$ C. in the temperature range of between about 0° C. and about 150° C.

18. An electrophotographic imaging process according to claim 10 wherein the difference in thermal contraction coefficient between said substrate layer and said charge transport layer is between about $-0.5\times10^{-5}/°$ C. and about $+0.5\times10^{-5}/°$ C. in the temperature range of between about 0° C. and about 150° C.

* * * * *